US006054656A

United States Patent [19]

Flierl et al.

[11] Patent Number: 6,054,656

[45] Date of Patent: Apr. 25, 2000

[54] CONTACTOR SAFETY INTERLOCK MECHANISM

[75] Inventors: Erwin Flierl, Rieden; Richard Freitag, Hahnbach-Süss, both of Germany

[73] Assignee: Siemens AG, Munich, Germany

[21] Appl. No.: 09/077,905

[22] Filed: Jun. 4, 1998

[30] Foreign Application Priority Data

Dec. 6, 1995 [DE] Germany ..... 195 45 540

[51] Int. Cl.[7] ..... H01H 9/26

[52] U.S. Cl. ..... 200/50.33

[58] Field of Search ..... 200/50.01, 50.4, 200/50.32

[56] References Cited

U.S. PATENT DOCUMENTS

| | | | |
|---|---|---|---|
| 2,359,606 | 10/1944 | Ballou | 20/50.35 |
| 2,604,796 | 7/1952 | Freese | 200/50.32 |
| 3,391,257 | 7/1968 | Frank | 200/50.36 |
| 3,735,295 | 5/1973 | Grunert et al. | 200/50.35 |
| 3,736,538 | 5/1973 | Owen | 200/50.35 |
| 3,953,697 | 4/1976 | Teichert | 200/DIG. 42 |
| 4,544,814 | 10/1985 | Butterworth et al. | 200/50.33 |

FOREIGN PATENT DOCUMENTS

| | | |
|---|---|---|
| 24 40 361 | 3/1976 | Germany . |
| 36 02 692 | 8/1987 | Germany . |

*Primary Examiner*—J. R. Scott
*Attorney, Agent, or Firm*—Kenyon & Kenyon

[57] ABSTRACT

A contactor safety combination includes two contactors and a mechanical interlocking module coupled between them. It is possible to use conventional contactors of any size, i.e., even high-capacity loads are switchable with the contactor safety combination of the present invention. At the same time, this design approach dispenses with a third contactor conventionally used for the interlocking.

19 Claims, 7 Drawing Sheets

CONTACTOR SAFETY INTERLOCK MECHANISM

The invention relates to a contactor safety combination which includes a reloclosing lockout which provides mutual interlocking of contactors.

BACKGROUND INFORMATION

Contactor safety combinations are known as electrical circuit arrangements. Most conventional contractor safety arrangements are composed of three auxiliary contactors or relays. As shown in FIG. 8, the position of contactors K2 and K3 is queried via a pre-contactor K1 before the closing operation. In trouble-free operation, the enabled circuit, composed of the series connection of the break-contact element K1, the make-contact element K2 and the make-contact element K3, is enabled by the break-contact element K1. Even in the event of a malfunction, reliable circuit-breaking is ensured due to the series connection of the make-contact elements K2 and K3. The reliability of these designs is guaranteed by an electrical interlock and position query, respectively, of contactors K1, K2 and K3. Characteristic of this specific embodiment is a high expenditure of time and energy for circuit wiring. To avoid wiring errors, the main portion of the necessary wiring is provided via a printed-circuit board. The quality of the enabling conducting path on the printed-circuit board determines the permissible current. In conventional contactor safety combinations, this lies below the permissible current of the individual contactors.

German Patent Application No. 24 40 361 describes a conventional interlocking module which interconnects two contactors using their operating heads. In this case, the interlocking module is not used as a reclosing lockout in the fault condition of one of the two contactors, but rather to ensure that during the normal operation in the "ON" switching state of the one contactor, as the result of positively driven operation, the other contactor is in the "OFF" switching state.

Furthermore, German Pat. application Ser. No. 36 02 692 describes a reclosing lockout of a relay. Realized here is the reclosing lockout of a relay switching two contact arrangements simultaneously using a switching finger. A shared contact element, on which a pointer is formed, engages with the two movable contacts of the contact arrangements. The free end of the pointer lies in the track of travel of the switching finger when both movable contacts are in the same position. The pointer and the switching finger are so narrow that the actuating surface of the pointer lies outside of the track of travel of the switching finger when the contact element is tilted because the two movable contacts are in a different position, i.e. when one of the contacts sticks.

SUMMARY OF THE INVENTION

An object of the present invention is to provide a contactor safety combination which is simply and cost-effectively constructed, permits the use of contactors of any size desired, and uses only two contactors.

To achieve the object of the present invention, a contactor safety combination includes two contactors having contact carries and a reclosing lockout having an interlocking module which is releasably coupled to the contact carriers. The two contactors are mutually interlocking. An advantage of this design approach is that it permits the switching of contactors of any size, and that the switching of high-capacity loads is also possible. In this context, conventional contactors, in conjunction with the interlocking module, can be assembled by the customer to form a contactor safety combination. The design approach is suitable both for AC and for DC contractors.

DETAILED DESCRIPTION OF THE INVENTION

Figure 1:
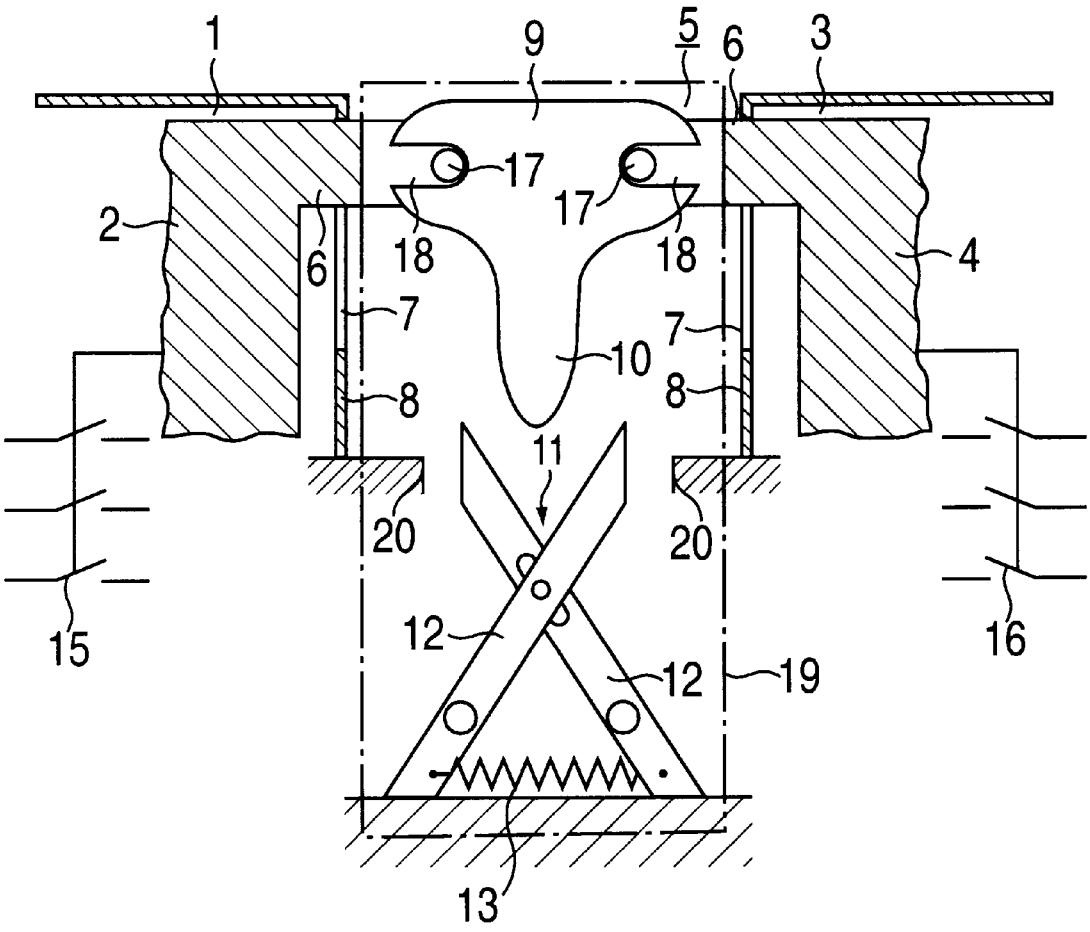
FIG. 1 shows an interlocking module coupling two contactors; the two contactors are shown in an undisturbed state before a closing operation.

FIG. 1 shows an interlocking module 5, as well as, indirectly, a first contactor 1 and a second contactor 3 coupled by an interlocking module 5, resulting in a contactor safety combination. FIG. 1 shows the position of contactors 1 and 3 before the closing operation in the undisturbed state. Each of the two contactors 1 and 3, has a contact carrier, i.e., a first contact carrier 2 and a second contact carrier 4, by which—make-contact 15 and 16, respectively, are switchable. Contact carriers 2 and 4, respectively, have premoldings 6 which protrude through a cutout 7 in respective housing wall 8 of contactors 1 and 3, and which are provided at the extremity with a round journal 17. In this context, cutouts 7 are so dimensioned in shape that, during the closing operation of make-contacts 15 and 16, respectively, premoldings 6 on contact carriers 2 and 4 can move freely within said cutouts. Interlocking module 5 includes a heart-shaped coupling element 9 whose tip is a nose-shaped projection 10, as well as two rotationally mounted bars 12 lying crossed in a scissors shape, whose ends directed toward coupling element 9 taper to a point, while the ends facing away are interconnected by a tension spring 13. Interlocking components 9, 12, 13 are arranged in a rectangular-shaped housing 19. The two bars 12 form an opening 11 into which nose-shaped projection 10 of coupling element 9 plunges during the closing operation of contactors 1 and 3. Coupling element 9, arranged above opening 11, has slots 18 at each side into which round journals 17 of premoldings 6 of both contactors 1 and 3 are inserted. This provides pivot bearings, which retain coupling element 9, coupling element 9 being rotatable about its center of mass. Next to the tapered bar ends, provision is made on the sides facing housing 19 of interlocking module 5 for limit stops 20, whose function is described below.

Figure 2:
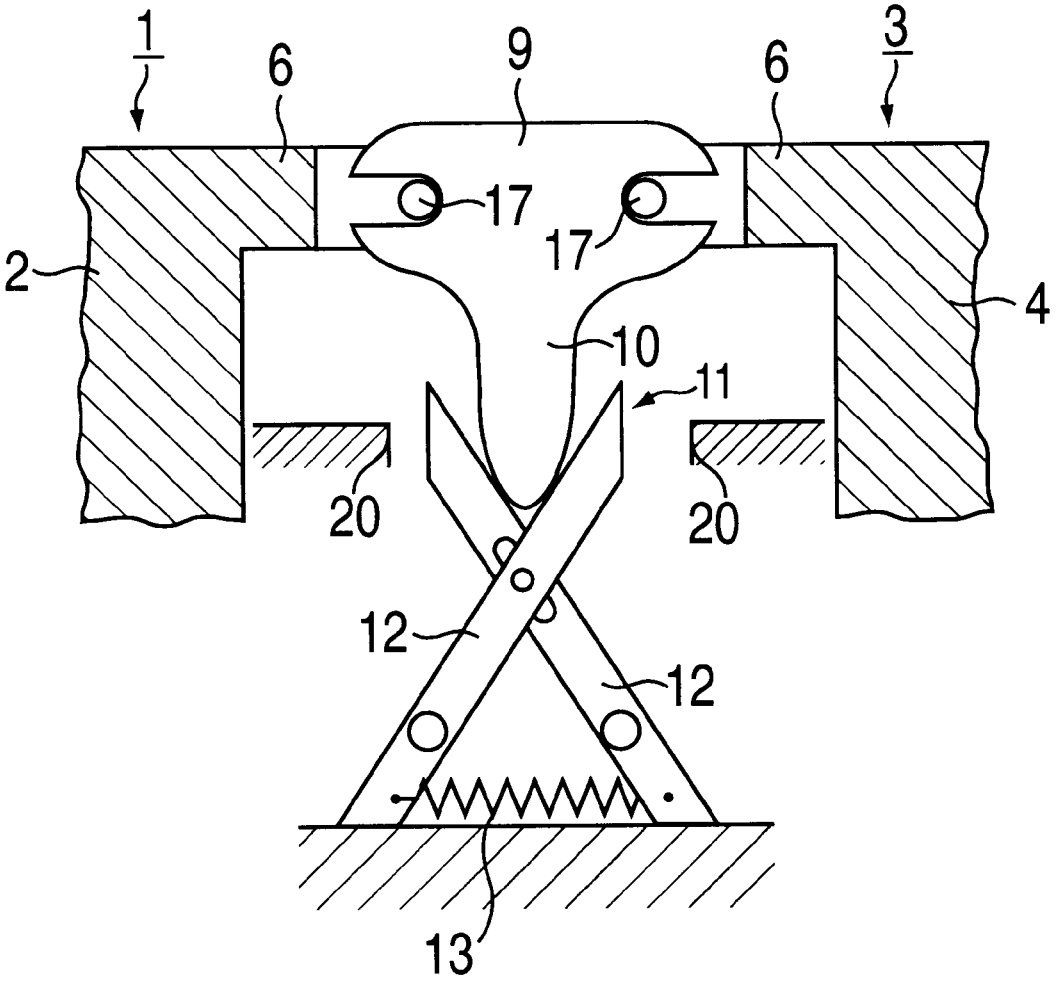
FIG. 2 shows the interlocking module coupling the two contactors; the contactors are shown in the undisturbed state after the closing operation.

FIG. 2 shows the position of contactors 1 and 3, (i.e., the position of contact carriers 2 and 4) after the closing operation of the make-contacts, (not shown) in the undisturbed state. Corresponding to the contact travel of contact carriers 2 and 4, coupling element 9 is also moved downward in the same direction during the closing operation and, in so doing, plunges into opening 11 formed by crossed bars 12. The contactor safety combination described is usable in the same manner for contactors, to be interlocked, having break contacts.

Figure 3:
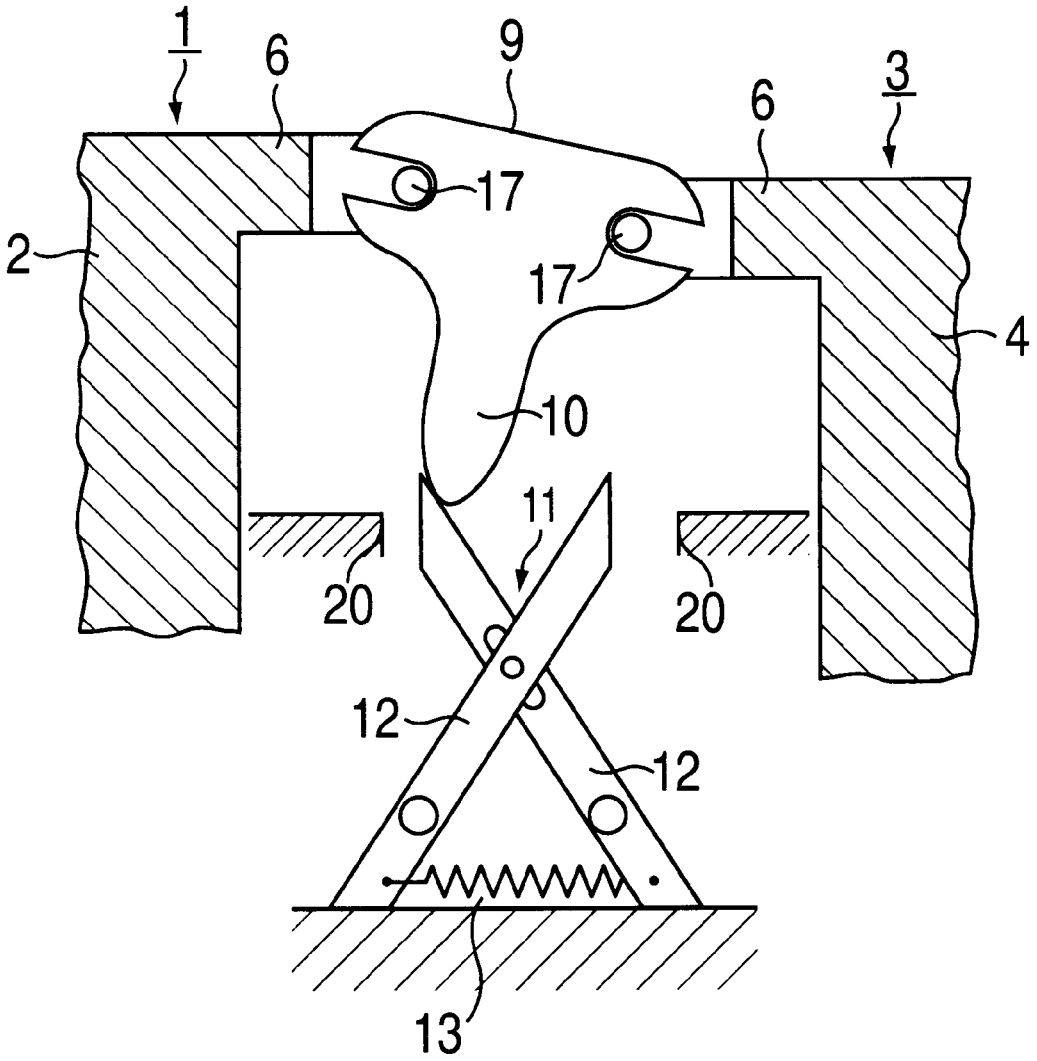
FIG. 3 shows an interlocking module coupling two contactors; the two contactors are shown in the disturbed state during an opening operation.

FIG. 3 shows the disturbed state of the contactor safety combination during the opening operation. The disturbed state is owing to a welding of one of make-contacts 15 or 16, a make-contact 16 of second contactor 3 being welded in the case here, so that the associated second contact carrier 4 is caught, and the other first contact carrier 2 of undisturbed first contactor 1 moves freely upward. The mounting support of coupling element 9 via pivot bearings 17,18 renders such a movement possible, during which coupling element 9 rotates, and its nose-shaped projection 10 slides along on the inner side of the one bar 12. The pressure exerted on bar 12 in so doing can be absorbed without difficulty, i.e. without damaging stress, because of the rotatable mounting of bars 12 in conjunction with tension spring 13.

Figure 4:
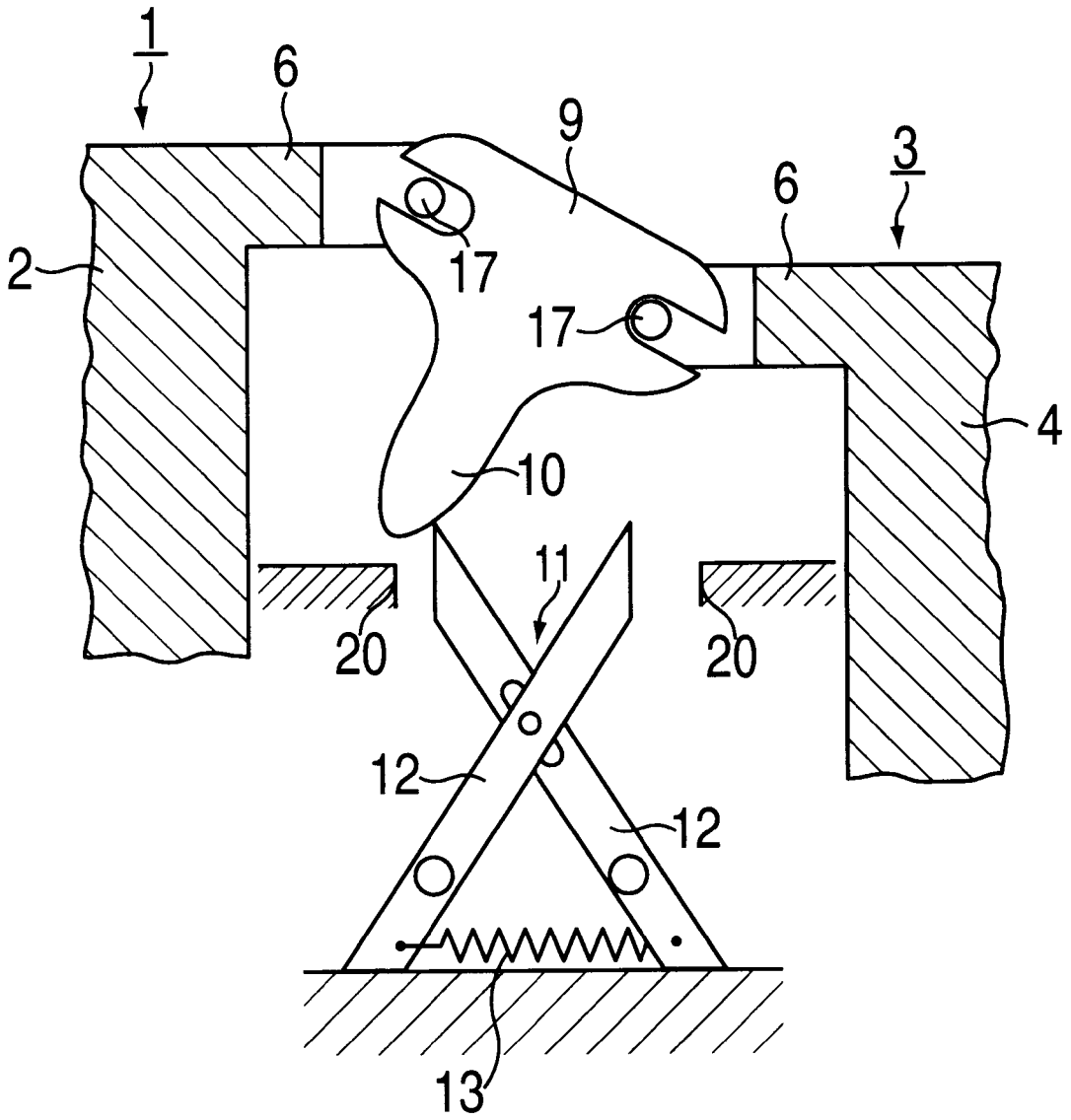
FIG. 4 shows an interlocking module coupling two contactors; the two contactors are shown in the disturbed state after termination of the opening operation.

FIG. 4 shows the position of contact carriers 2 and 4, as well as of coupling element 9, after termination of the opening operation. Nose-shaped projection 10 grabs the tapered end of bar 12, which is facing undisturbed first contactor 1, from behind, and at the same time, rests on the one limit stop 20. Coupling element 9 blocked in this manner prevents a new closing operation of first contactor 1. Correspondingly, second contactor 3 is also locked, after one of make-contacts of first contactor 1 is welded. This means that an enabling is only effected when a closing operation takes place from a disturbance-free state, i.e., make-contacts 15 and 16, respectively, are not welded.

Figure 5:
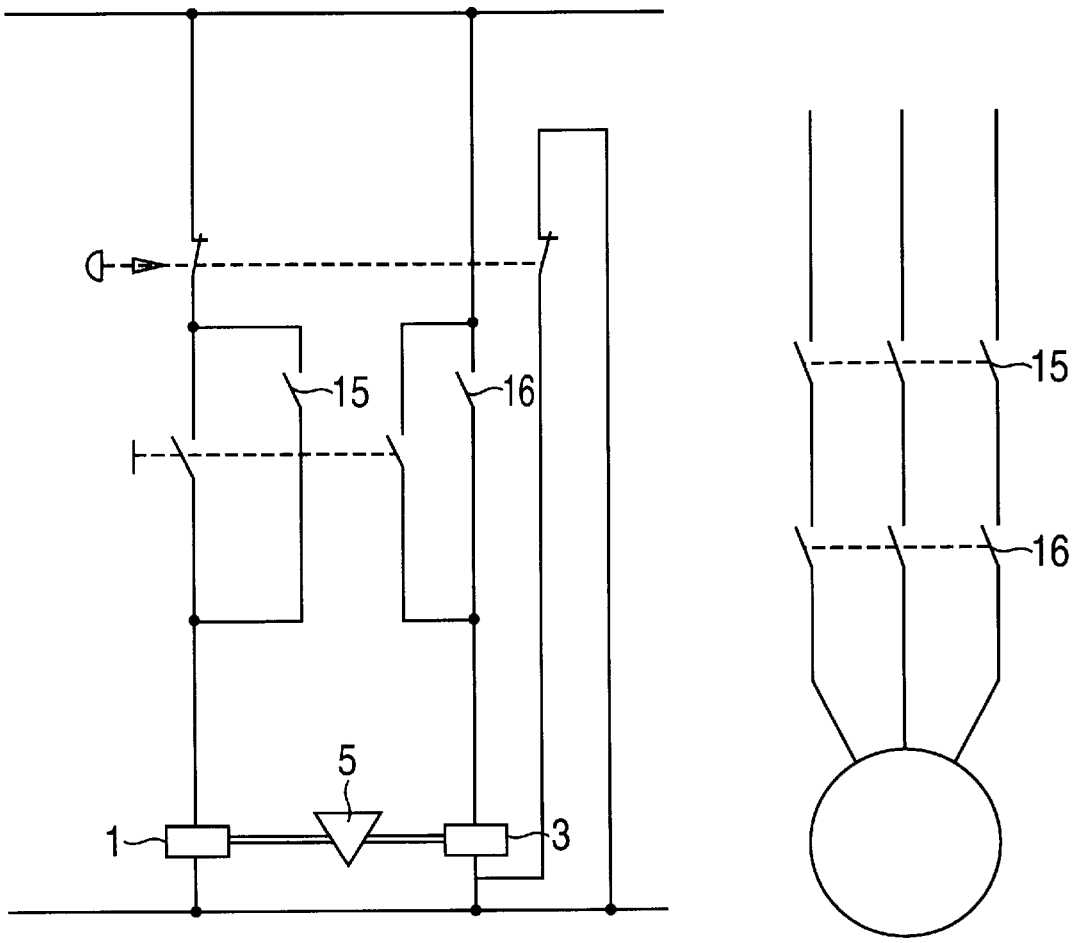
FIG. 5 shows an electrical circuit of the contactor safety combination in accordance with an exemplary embodiment of the present invention.

FIG. 5 shows a circuit diagram of the contactor safety combination. Make-contacts 15 and 16 of contactors 1 and 3 are connected in series. Therefore, a breaking operation can also still be carried out when make-contacts at one of contactors 1 or 3 weld during or after the closing operation. The interlocking is so designed that the contactors can open independently of one another. The error is reliably recognized during the next closing operation. The wiring expenditure is limited to the direct driving of the coils and the wiring of the enabled circuits. For the combination, there is no need to limit the data from the individual units, because the wiring is suitably designed for the contacting task.

Figure 6:
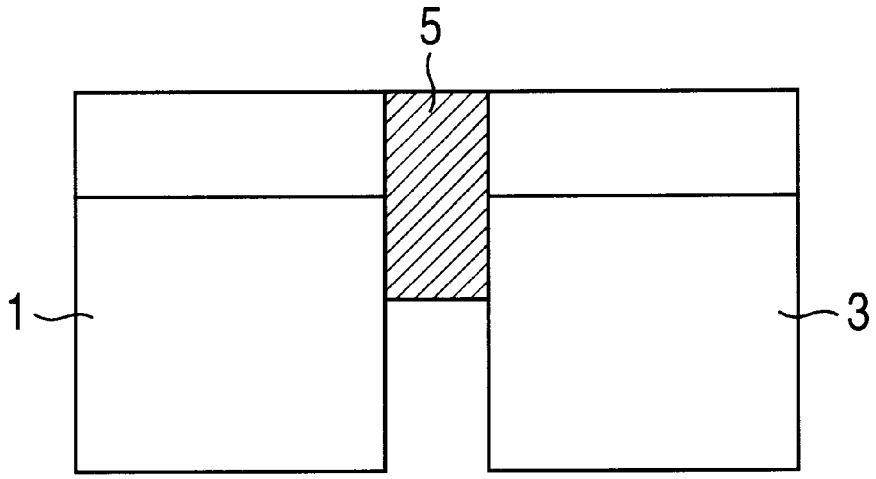
FIG. 6 shows the interlocking module of FIGS. 1–4 arranged between the two contactors.
Figure 7:
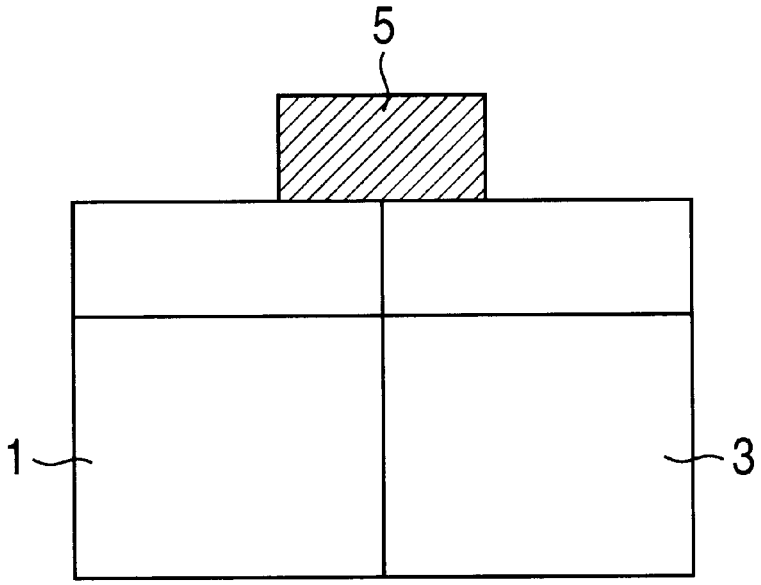
FIG. 7 shows the interlocking module of FIGS. 1–4 arranged at a front side of the two contactors.
Figure 8:
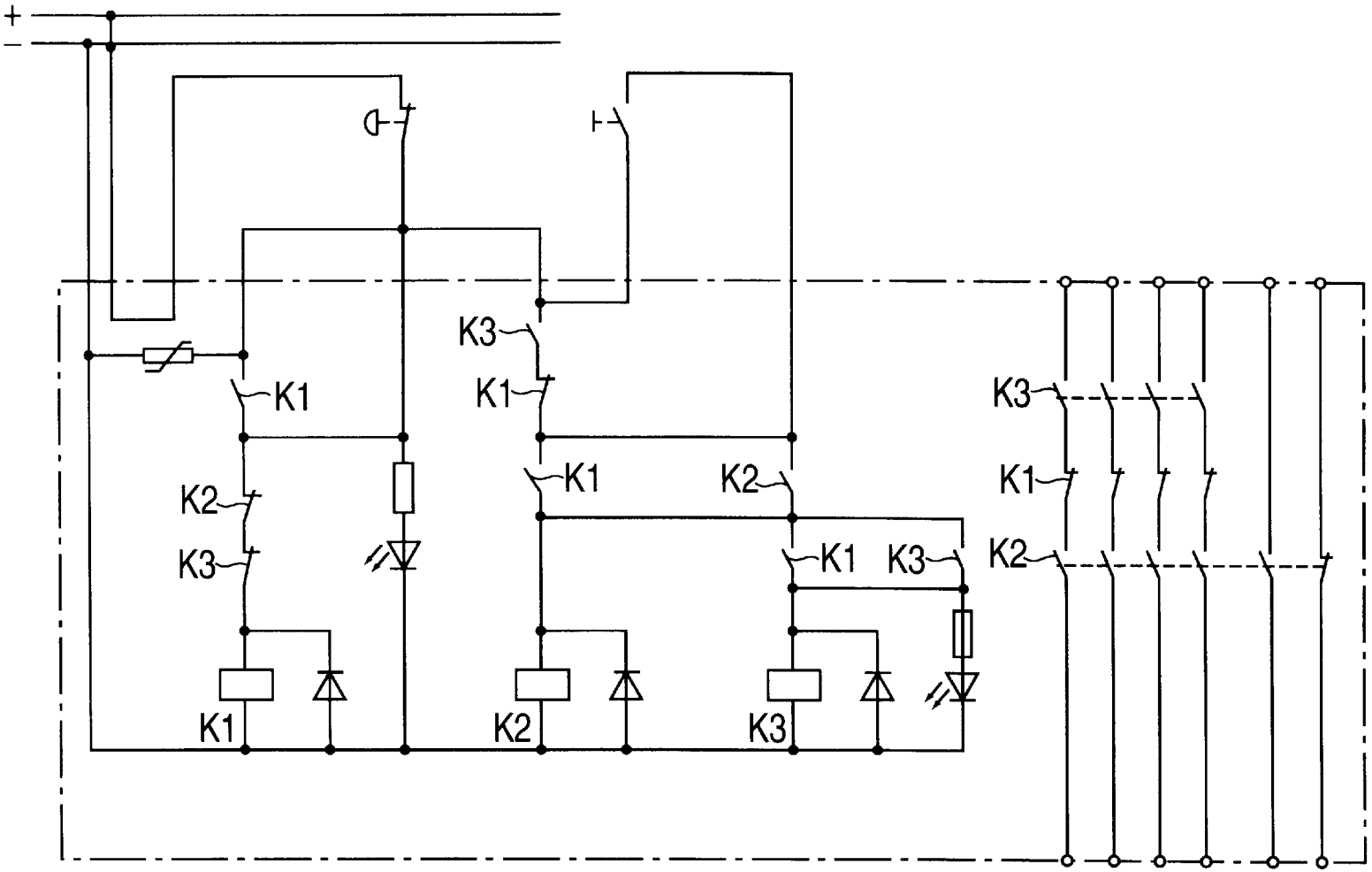
FIG. 8 shows a conventional circuit arrangement.

Interlocking module 5 can be located both between the contactors (see FIG. 6), on the front side (FIG. 7) of said contactors, and below the contactors.

The contactor safety combination described also has the advantage that, given light welding of a contactor, the possibility exists that, during the closing-operation attempt, the second contactor will release the welding. Auxiliary switches, components and other accessories can still be used for the contactors.

What is claimed is:

1. A contactor safety assembly comprising:

a first contactor including a first contact carrier;

a second contactor including a second contact carrier; and an interlocking module including a coupling element, the coupling element being pivotably coupled to the first and second contact carriers, the first and second contactors being mutually interlocking via the interlocking module.

2. The contactor safety assembly according to claim 1, wherein the coupling element is pivotably coupled to the first and second contactors via a plug-in connection.

3. The contactor safety assembly according to claim 1, wherein the first contactor includes a first housing wall having a first cut-out, and the second contactor includes a second housing wall having a second cut-out, and wherein the first contact carrier includes a first premolding for coupling to the coupling element of the interlocking module, the second contact carrier includes a second premolding for coupling to the coupling element of the interlocking module, the first premolding protrudes through the first cut-out, and the second premolding protrudes through the second cut-out.

4. The contactor safety assembly according to claim 3, wherein the interlocking module further includes an interlocking mechanism having an opening and wherein the coupling element includes a nose-shaped projection, the coupling element being configured to plunge the nose-shaped projection into the opening during a closing operation of the first contactor and the second contactor.

5. The contactor safety assembly according to claim 4, wherein the coupling element is retained on the first premolding and the second premolding via a respective pivot bearing.

6. The contactor safety assembly according to claim 4, wherein the interlocking mechanism includes two rotationally mounted bars coupled by a tension spring, the two rotationally mounted bars positioned in a crossed manner in a shape of a scissor, the opening in the interlocking mechanism being formed by the two rotationally mounted bars.

7. The contactor safety assembly according to claim 6, wherein each of the first contactor and the second contactor includes a respective make-contact, and the coupling element has a center of mass, and wherein during an opening operation of the first contactor and the second contactor, and after one make-contact has welded, the coupling element rotates about the center of mass, moves out of the opening and grabs one of the two rotationally mounted bars from behind to block a closing-operation movement.

8. The contactor safety assembly according to claim 1, wherein the interlocking module is positioned between the first contactor and the second contactor.

9. The contactor safety assembly according to claim 1, wherein interlocking module is positioned on a front side of the the first contactor and the second contactor.

10. A contactor safety assembly comprising:

two contactors, each of the two contactors including a respective contact carrier; and an interlocking module pivotably coupled to each respective contact carrier, the two contactors being mutually interlocking via the interlocking module.

11. The contactor safety assembly according to claim 10, wherein each of the two contact carriers includes a respective journal, and the interlocking module includes a coupling element including two slots, each of the two slots receiving the respective journal of a respective one of the two contact carriers.

12. The contactor safety assembly according to claim 11, wherein the coupling element includes a nose-shaped projection, the contactor safety assembly further comprising:

an interlocking mechanism having an opening, wherein during a closing operation of the two contact carriers, the nose-shaped projection plunges into the opening.

13. The contactor safety assembly according to claim 11, wherein each of the two contactors includes a housing wall having a respective cut-out, and wherein each respective contact carrier includes a respective premolding for coupling to the interlocking module, the premolding protruding through the respective cut-out.

14. The contactor safety assembly according to claim 13, further comprising:

an interlocking mechanism having an opening;

wherein the interlocking module includes a coupling element coupled to each respective premolding, the coupling element including a nose-shaped projection, wherein during a closing operation of the two contactors in an undisturbed state, the coupling element plunges the nose-shaped projection into the opening.

15. The contactor safety assembly according to claim 13, wherein the coupling element is retained on each respective premolding via a respective pivot bearing.

16. The contactor safety assembly according to claim 14, wherein the interlocking mechanism includes two rotationally mounted bars coupled by a tension spring, the two rotationally mounted bars positioned in a crossed manner in a shape of a scissor, the opening in the interlocking mechanism being formed by the two rotationally mounted bars.

17. The contactor safety assembly according to claim 16, wherein each of the two contactors includes a respective make-contact and the coupling element has a center of mass, and wherein during an opening operation of the two contactors and after one make-contact has welded, the coupling element rotates about the center of mass, moves out of the opening and grabs one of the two rotationally mounted bars from behind to block a closing-operation movement.

18. The contactor safety assembly according to claim 10, wherein the interlocking module is positioned between the two contactors.

19. The contactor safety assembly according to claim 10, wherein interlocking module is positioned on a front side of the two contactors.

* * * * *